US009533825B2

(12) United States Patent
Baumert

(10) Patent No.: US 9,533,825 B2
(45) Date of Patent: Jan. 3, 2017

(54) FIRE-STOPPING AND FIRE-SMOTHERING STORAGE CONTAINER

(71) Applicant: BAUMERT (SOCIETE PAR ACTIONS SIMPLIFIEE UNIPERSONNELLE), Schaeffersheim (FR)

(72) Inventor: Bernard Baumert, Schaeffersheim (FR)

(73) Assignee: BAUMERT (SOCIETE PAR ACTIONS SIMPLIFIEE UNIPERSONNELLE), Schaeffersheim (FR)

( * ) Notice: Subject to any disclaimer, the term of this patent is extended or adjusted under 35 U.S.C. 154(b) by 0 days.

(21) Appl. No.: 14/781,838

(22) PCT Filed: Apr. 2, 2013

(86) PCT No.: PCT/FR2013/050725
§ 371 (c)(1),
(2) Date: Oct. 1, 2015

(87) PCT Pub. No.: WO2014/162065
PCT Pub. Date: Oct. 9, 2014

(65) Prior Publication Data

US 2016/0039604 A1 Feb. 11, 2016

(51) Int. Cl.
*B65D 88/52* (2006.01)
*B65D 90/02* (2006.01)
(Continued)

(52) U.S. Cl.
CPC ..... *B65D 88/528* (2013.01); *B65D 90/008* (2013.01); *B65D 90/022* (2013.01); *B65D 90/023* (2013.01);
(Continued)

(58) Field of Classification Search
CPC ..... B65D 88/528; B65D 90/08; B65D 90/023; A62C 2/06
(Continued)

(56) References Cited

U.S. PATENT DOCUMENTS 3,575,312 A 4/1971 Luisada et al.
2007/0000921 A1 1/2007 Butler et al.

FOREIGN PATENT DOCUMENTS

AT 414 121 B 9/2006
DE 44 22 225 A1 1/1996
(Continued)

OTHER PUBLICATIONS

International Search Report, dated Dec. 13, 2013, from corresponding PCT Application.

*Primary Examiner* — Stephen Castellano
(74) *Attorney, Agent, or Firm* — Young & Thompson

(57) ABSTRACT

A fire-stopping and fire-smothering storage container housing an inner space for storing materials which is defined, relative to the outside space (2), by a plurality of sides (3*a*, 3*b*, 3*c*, 3*d*, 3*e*, 3*f*) and including at least one fire door assembly (4). The container provides an essentially fire-stopping, airtight structure of walls (5, 5') forming, together with the door assembly (4) which is also airtight, each side of the container, a system for attaching and assembling the structure and the door assembly, air passages (9*a*, 9*b*) extending through the structure, and air-sealing gaskets (8) making it possible to make the air passages airtight, such as to make the container airtight enough to create an air-depriving effect in the inner storage space that rapidly smothers any fire that starts inside of same.

16 Claims, 8 Drawing Sheets

Figure 1:
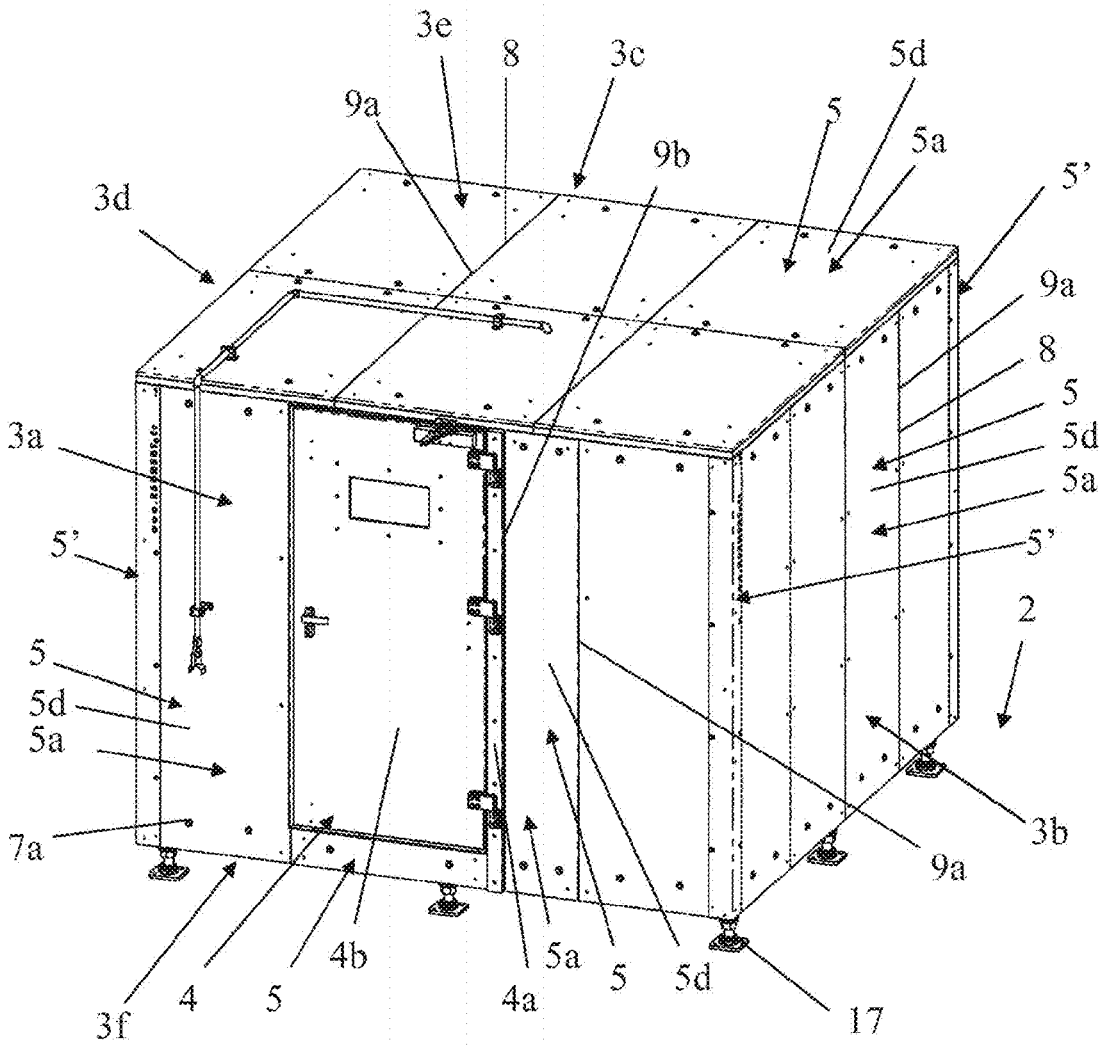

(51) Int. Cl.

| | |
|---|---|
| ***B65D 90/06*** | (2006.01) |
| ***B65D 90/08*** | (2006.01) |
| ***B65D 90/14*** | (2006.01) |
| ***B65D 90/22*** | (2006.01) |
| ***B65D 90/00*** | (2006.01) |

(52) U.S. Cl.
CPC ..... *B65D 90/06* (2013.01); *B65D 90/08* (2013.01); *B65D 90/14* (2013.01); *B65D 90/22* (2013.01)

(58) Field of Classification Search
USPC ..... 220/4.28, 88.1, 560.01
See application file for complete search history.

(56) References Cited

FOREIGN PATENT DOCUMENTS

| | | | |
|---|---|---|---|
| DE | 10 2004 002 945 | A1 | 8/2005 |
| FR | 2104373 | A5 | 4/1972 |

FIRE-STOPPING AND FIRE-SMOTHERING STORAGE CONTAINER

This application is the national stage (Rule 371) of PCT/FR2013/050725 filed Apr. 2, 2013.

This invention relates to the field of fire safety and lightweight construction housing particularly combustible and/or dangerous materials, and it has as its object a fire-resistant and fire-smothering storage container.

It is known that a storage container is a lightweight construction that is placed inside a building or outdoors and that is suited to house combustible and/or dangerous materials such as armatures, electrical equipment, gas bottles, barrels, tanks or other containers containing, for example, chemical, toxic or polluting products.

Such a storage container, which comprises a plurality of sides that delimit its internal storage area from the external area, generally has a rectangular parallelepiped shape comprising two opposite horizontal sides, upper and lower, that form respectively the roof and the floor and four vertical lateral sides that connect said upper and lower sides to each other. In addition, it also comprises an access opening, for persons and materials to pass through, made in one of the lateral sides and closed by a door unit comprising a doorframe and at least one door leaf that is assembled, generally pivoting, in the latter.

Furthermore, to protect the materials stored in these containers, each side is made starting with a fire-resistant wall, or partition, of a single piece, which imparts to the container an effective fire resistance, which meets the current fire standards, making it possible to protect, as necessary, the stored materials against flames and hot gases coming from a fire starting outside of the container or to protect the environment outside of the container in the event of fire starting within its internal area.

However, in the case of a fire starting inside the container, if the fire-resistant partitions of these containers offer an effective fire resistance, of at least 90 minutes, making it possible for emergency services to intervene in the container to initiate the extinguishing of the fire, this time is too long to prevent the spread of flames or of hot gases from one material to the next. Moreover, during this time of fire resistance of the partitions, the combustible polluting or toxic products touched by the flames or the hot gases are likely to create toxic or polluting fumes that present a danger to the outside environment and/or the emergency services intervening near or in the container.

Another problem of the current fire-resistant containers, which are completely assembled at the factory before being delivered and installed on site, is their bulk and/or their weight that does not allow them to go through certain access openings made in the sides or the walls of buildings or to maneuver them easily.

This invention has as its object to remedy at least one of these drawbacks by proposing a fire-resistant and fire-smothering storage container that essentially makes it possible, in addition to the protection of the container against fire, to protect the materials contained in its storage area against fire by automatic extinguishing, within a few minutes, as necessary, of the fire that is igniting at least one of said materials. Furthermore, such a container offers the advantage of being able to be delivered in the disassembled state to be easily transportable and of being able to go through access openings of any size. If applicable, such a container can also be provided to be able to have the capability of being disassembled so as to be able to be disassembled directly on the site of its installation for the purpose of making it possible to remove said container easily and through said access openings of said container.

For this purpose, this invention, which has as its object a fire-resistant and fire-smothering storage container having an overall parallepiped shape, preferably a rectangular parallelepiped shape, and housing an internal storage area for storing materials, delimited, in relation to the external area of the container, by a plurality of sides, including at least one of the latter, comprises at least one access opening, which makes it possible for persons and materials to go through, closed by a fire-resistant door unit comprising a doorframe and at least one door leaf, being characterized in that it comprises:

- a wall structure that is essentially fire-resistant and airtight forming, as necessary with the door unit that is adapted also to be airtight, each side,
- an assembling and securing system, optionally comprising a reinforcing framing, preferably a rectangular parallelepiped shape, said system making possible the securing and assembling of said structure and of the door unit,
- air passages each extending through said structure or between two adjacent sides, by connecting the internal storage area and the external area,
- airtight seals, each placed in or applied against one of said air passages so as to seal the latter to make all or almost all of the air passages airtight so as to make, with the wall structure that is essentially fire-resistant and airtight, the container, in the closed state, sufficiently airtight to create in the internal storage area an air-depriving effect that automatically, within a few minutes, smothers and extinguishes any fire starting in said internal area.

Figure 2:
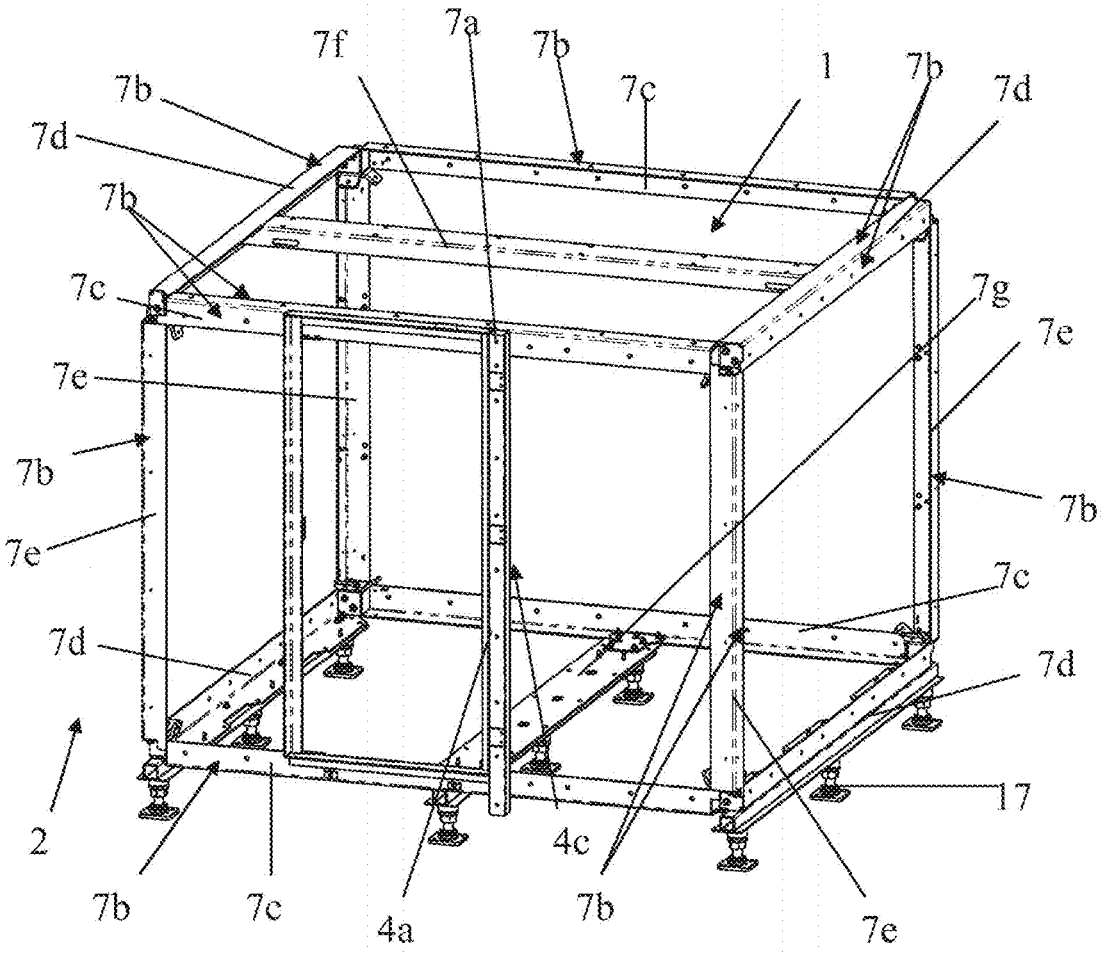
Figure 3:
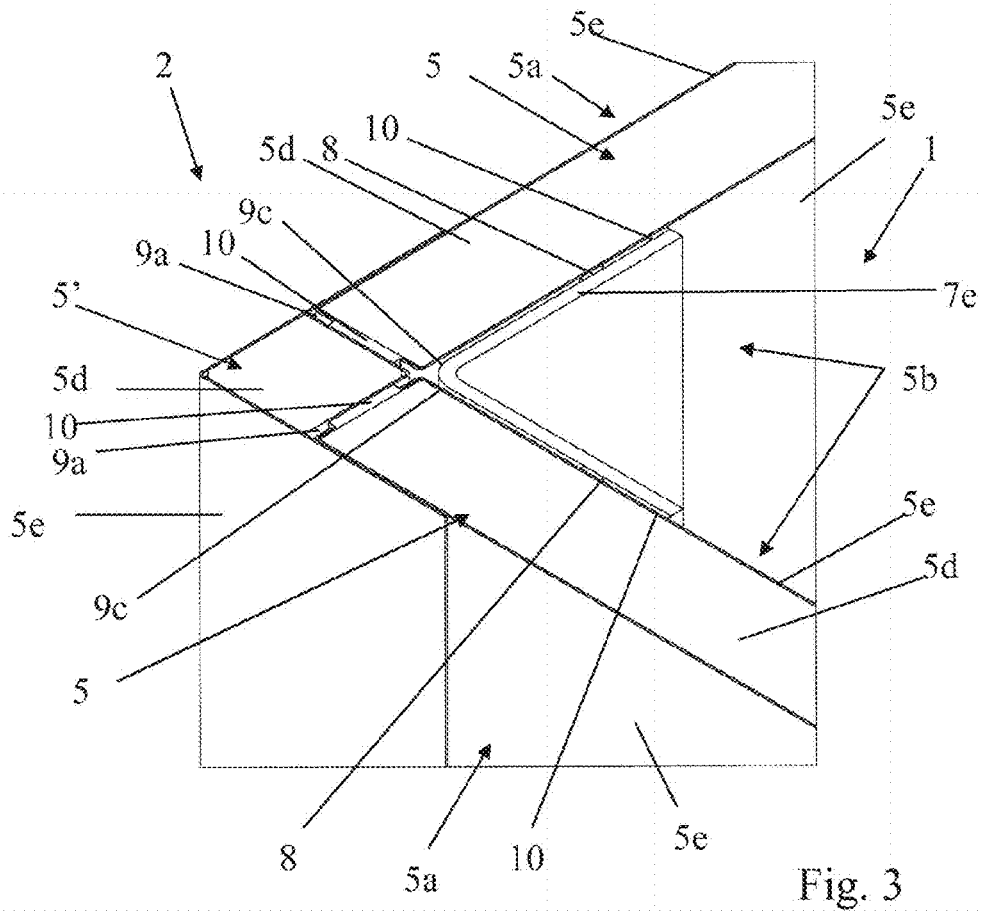
Figure 4:
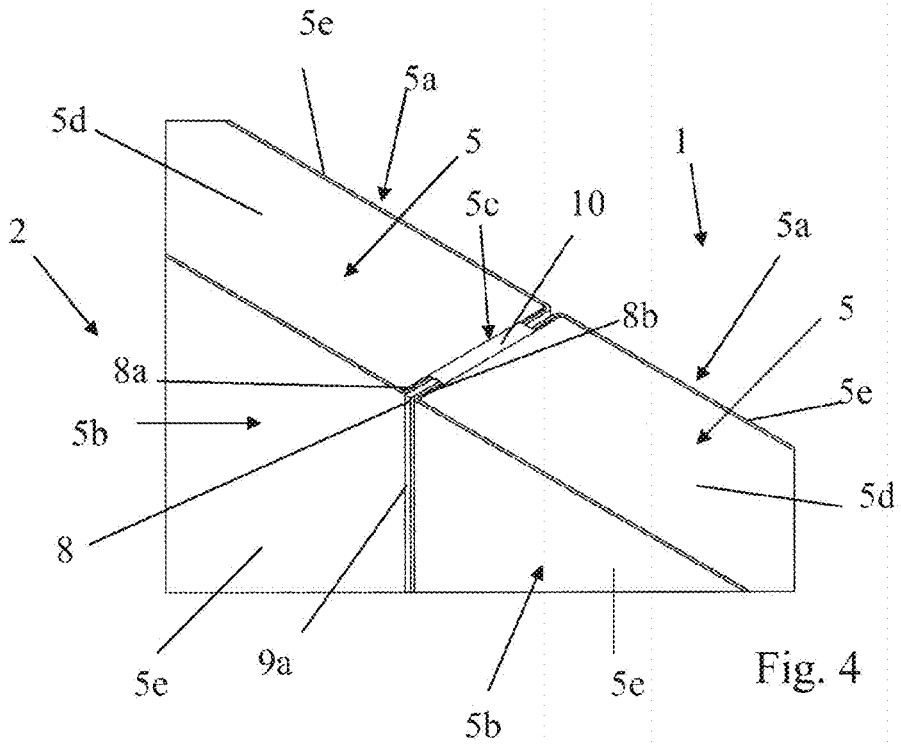
Figure 5:
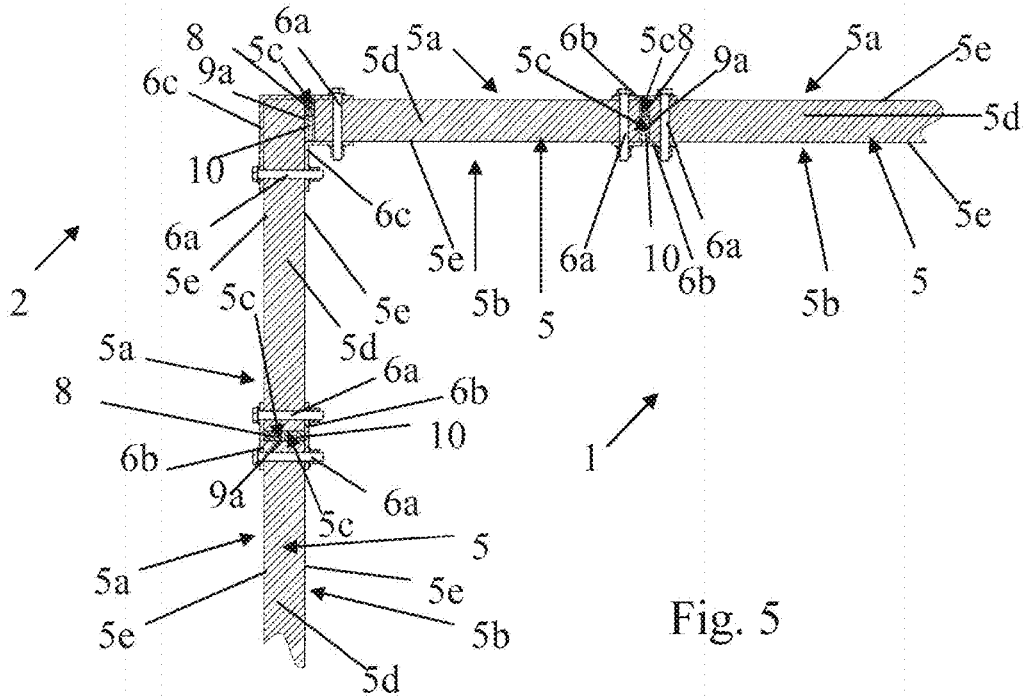
Figure 6:
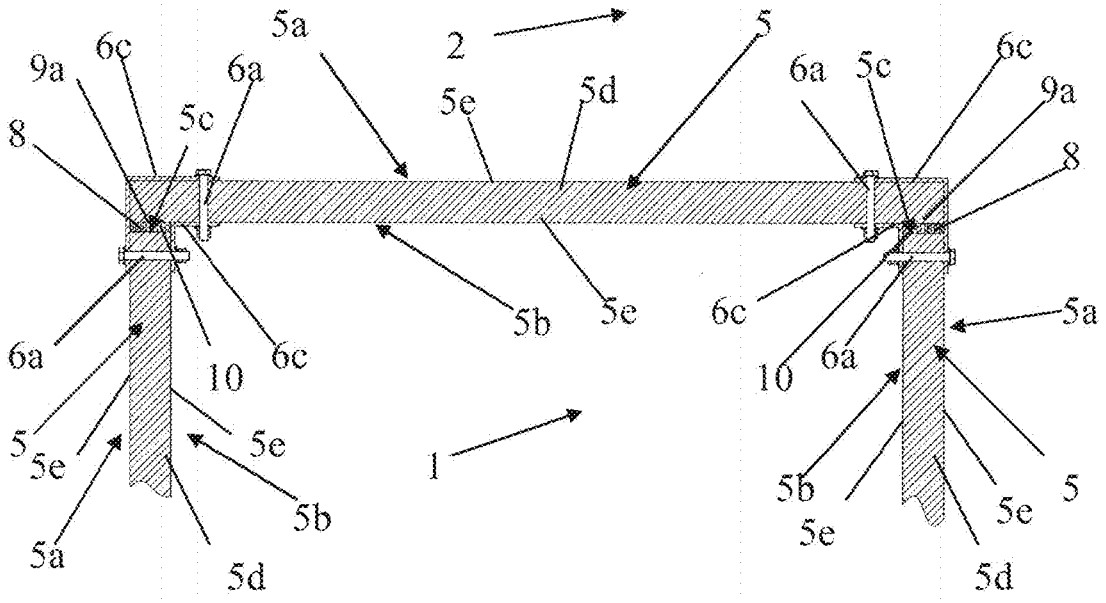
Figure 7:
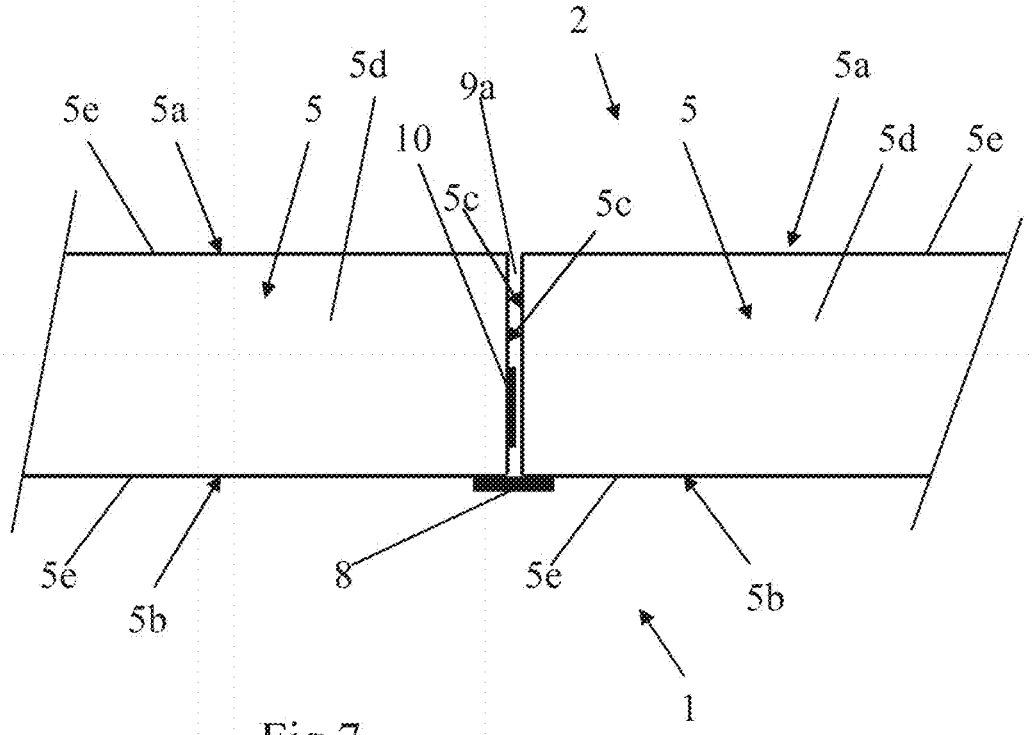
Figure 8:
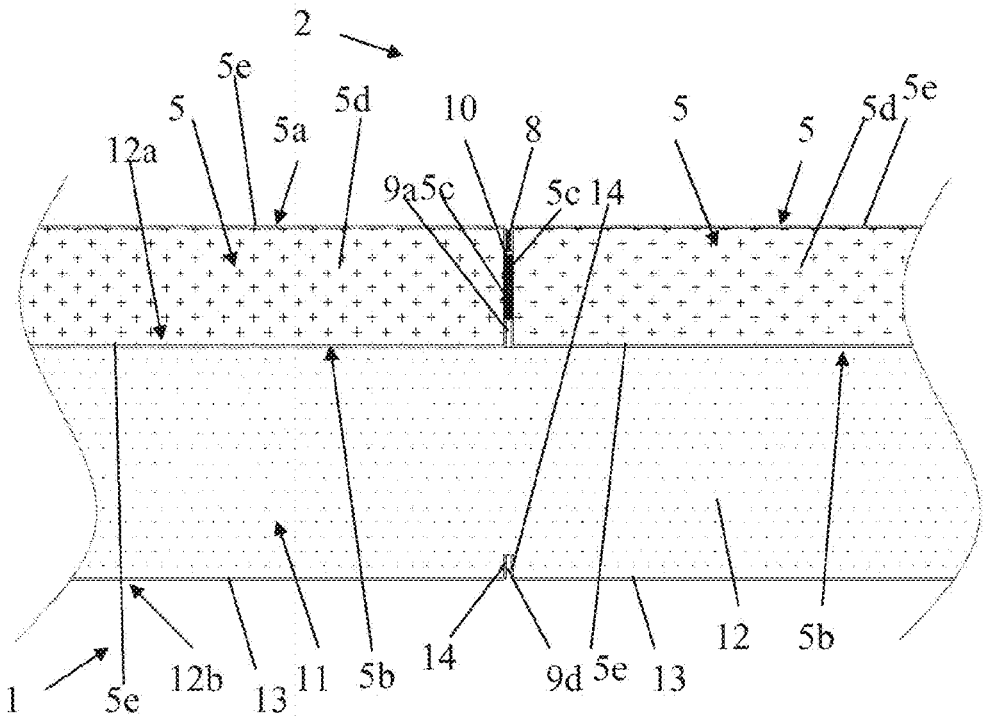
Figure 9:
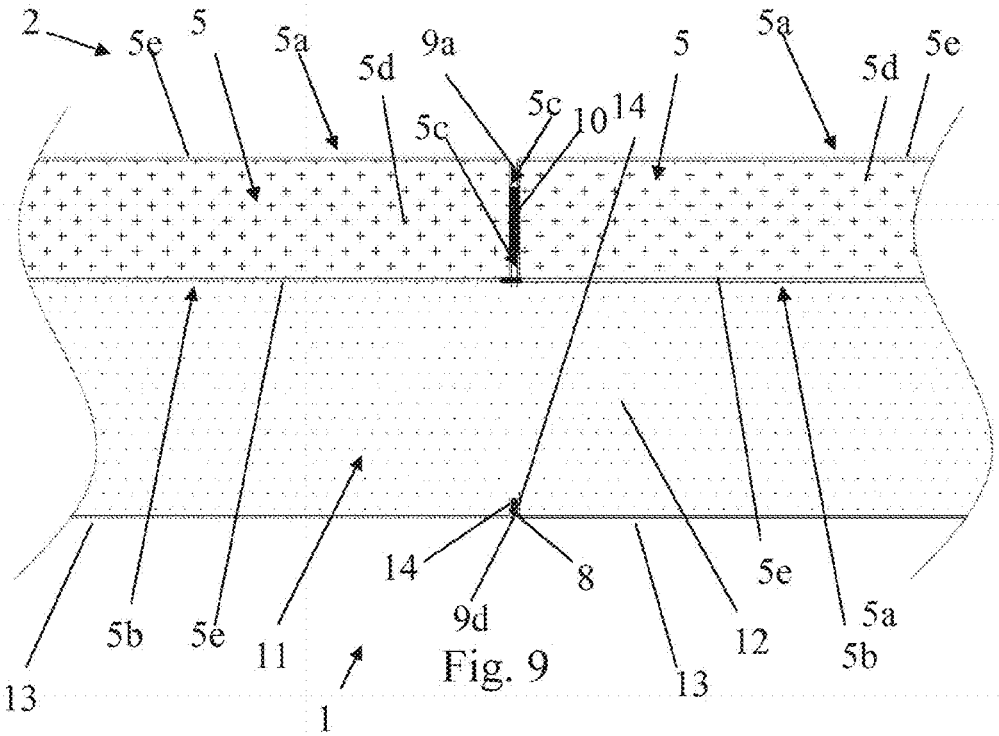
Figure 10:
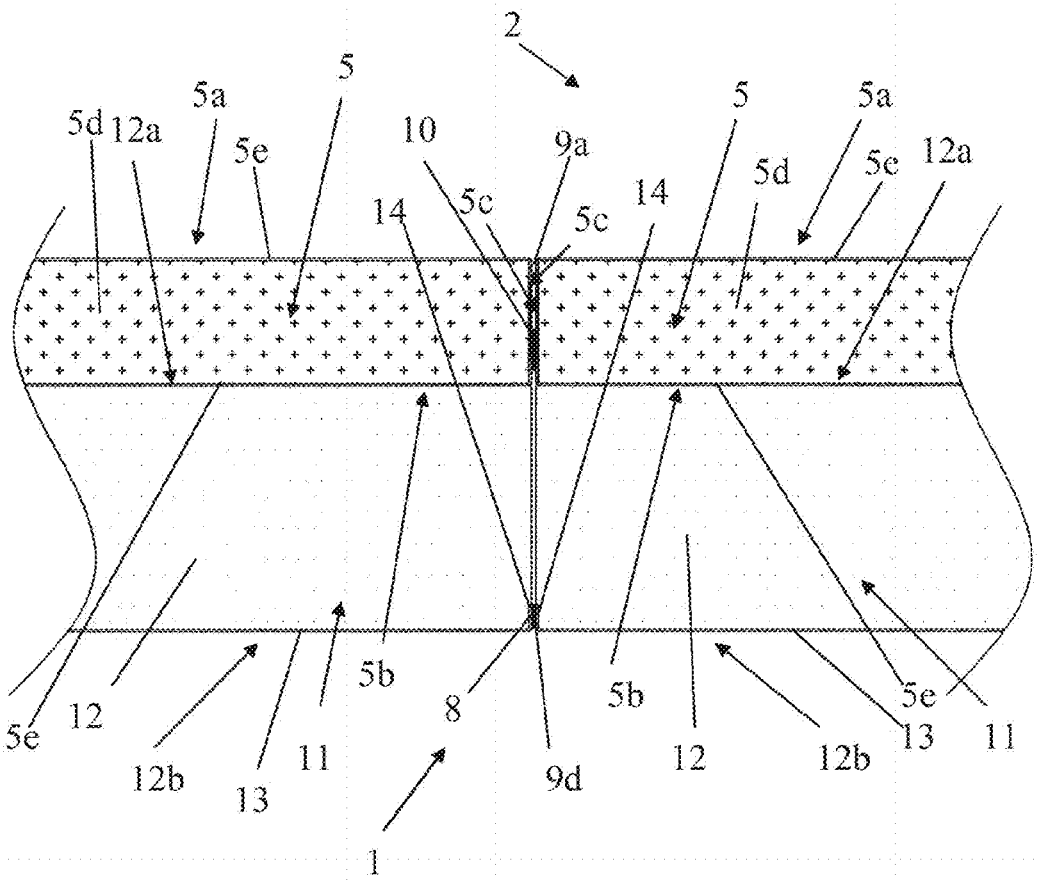
Figure 11:
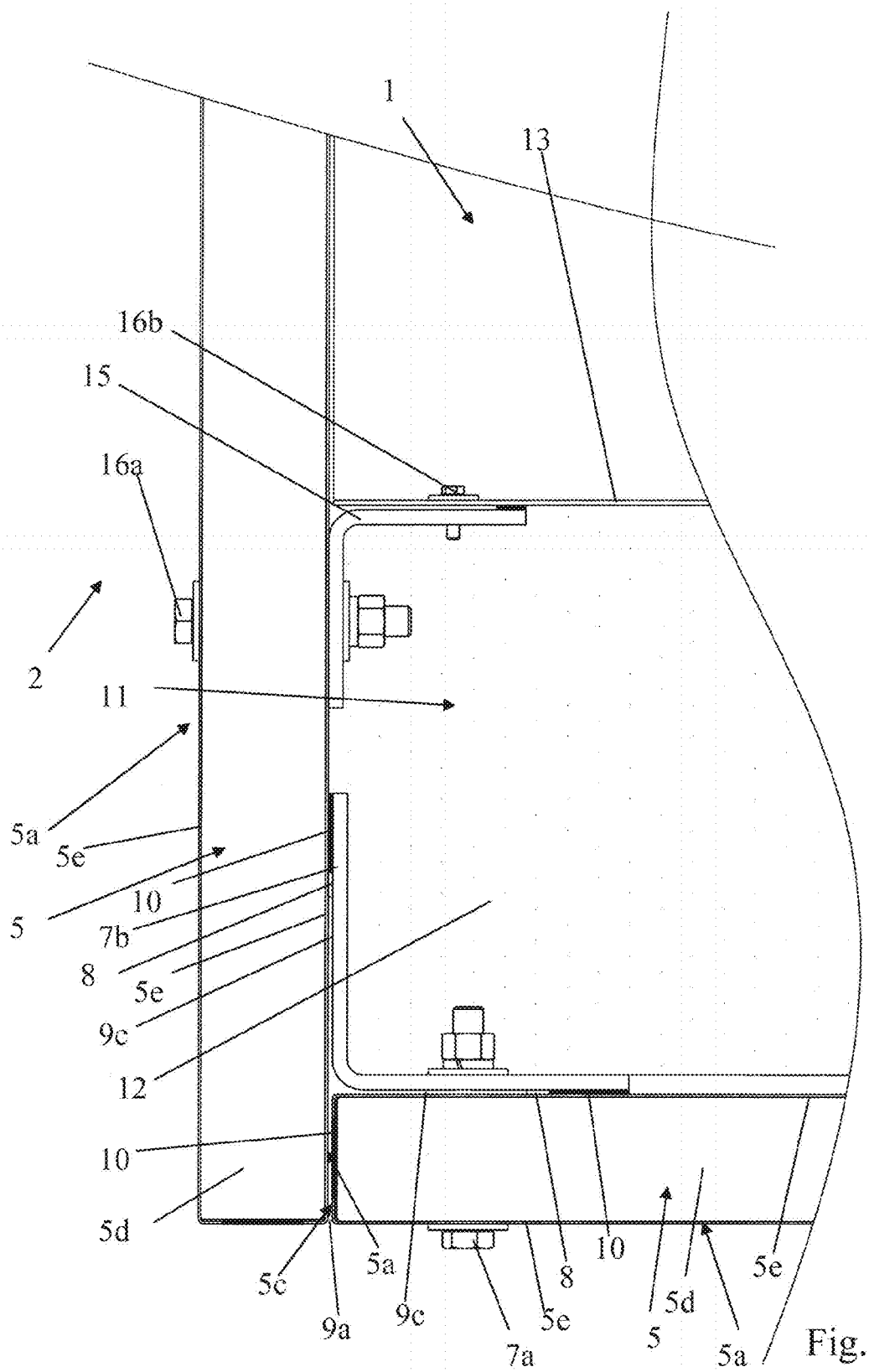

The invention will be better understood using the description below, which relates to at least one preferred embodiment, given by way of nonlimiting example and explained with reference to the accompanying diagrammatic drawings, in which:

FIG. 1 shows a perspective view of a container according to this invention, with a rectangular parallelepiped shape and placed on a horizontal floor, in a preferred embodiment of the wall structure, without thermal insulation, and in the second embodiment, with framing, of the securing and assembling system, FIG. 2 represents a perspective view of the rectangular parallelepiped-shaped framing of the container represented in FIG. 1 and of the doorframe of the door unit mounted on the latter, FIG. 3 shows a view, in perspective and in cutaway, in a horizontal plane, of one of the corner parts comprising one of the edges of the container represented in FIG. 1 delimited by two of its lateral sides, each formed by a plane of panels that is fastened to the framing and that is set back from the edge formed by a panel continuity and corner element that is elongated and of square cross-section, FIG. 4 shows a partial view, in perspective and in cutaway in a horizontal plane, of the main wall forming one of the lateral sides of the container represented in FIG. 1, in the area of the main gap that extends between two juxtaposed vertical panels, with one of the airtight seals and one of the fire-resistant seals placed in the gap, FIG. 5 shows a view, in cutaway in a horizontal plane, of one of the corner parts comprising one of the edges delimiting two lateral sides of a container according to this invention, in a preferred embodiment of the wall structure, without reinforced thermal insulation, and in the first embodiment of the securing system, without framing, with airtight seals and fire-resistant seals placed in the main gaps between the panels, FIG. 6 shows a view, in cutaway in a vertical plane, of the upper part of the container represented in FIG. 5, with airtight seals and fire-resistant seals placed in the main gaps between the panels, FIG. 7 shows a partial diagrammatic cutaway view, in a horizontal plane, of one of the lateral sides of a container according to this invention, in a preferred embodiment of the wall structure, with a main wall, in the area of the gap between two juxtaposed vertical panels, with one of the airtight seals located in the internal storage area, outside of said gap and against the opening of the latter protruding into said internal area, and one of the fire-resistant seals placed in said gap, FIG. 8 shows a partial diagrammatic cutaway view, in a horizontal plane, of one of the lateral sides of a container according to this invention, in a variant of the preferred embodiment of the wall structure, with a double wall comprising a main wall and an additional wall, in the area of one of the air passages comprising one of the main gaps made airtight and fire-resistant that goes through the main wall and one of the additional gaps that extends into the additional wall, FIG. 9 shows the contents represented in FIG. 8 with the additional gap made airtight and the main gap made fire-resistant only, FIG. 10 shows the wall structure of FIG. 9 with the additional wall in a variant comprising a juxtaposition of heat sealing elements, FIG. 11 shows a cutaway view, in a horizontal plane, of the securing means of the additional wall of the wall structure of a container according to this invention with a rectangular parallelepiped shape, in the area of one of the corner parts of the container delimited by two of its lateral sides.

The figures show a fire-resistant and fire-smothering storage container having an overall parallelepiped shape, preferably a rectangular parallelepiped shape, and housing an internal storage area 1 for the storage of materials, which is delimited, in relation to the external area 2 of the container, by a plurality of sides, namely two respectively upper opposite sides 3*e* and 3*f*, forming the roof, or a lower side, forming the floor, each extending preferably in a plane that is horizontal or parallel to the ground on which the container rests, and lateral sides 3*a*, 3*b*, 3*c*, 3*d* connecting the latter, each of them extending preferably in a vertical plane, said container comprising at least one access opening, making it possible for persons and materials to pass through, made in one of the lateral walls, and closed by a fire-resistant door unit 4 comprising a doorframe 4*a* and at least one door leaf 4*b* mounted in the latter.

The materials that are provided to be stored in such a container are combustible and/or dangerous materials, such as, for example, armatures, electrical equipment, gas bottles, barrels, tanks or other containers containing, for example, chemical, toxic or polluting products.

It will be noted that the door leaf 4*b* can be, for example, a swiveling or sliding door wing, preferably mounted to swivel in the doorframe 4*a*.

According to this invention, such a container comprises:

- a structure of walls 5 and/or 5' and/or 11 that are essentially fire-resistant and airtight, optionally with thermal insulation or reinforced thermal insulation, the wall structure forming, as necessary with the door unit 4 that is adapted also to be airtight, each side 3*a*, 3*b*, 3*c*, 3*d*, 3*e*, 3*f* of the container,
- a securing and assembling system 6*a*, 6*b*, 6*c* or 7*a*, 7*b*, 7*c*, 7*d*, 7*e*, optionally comprising a reinforcing framing 7*b*, 7*c*, 7*d*, 7*e*, the securing and assembling system making it possible to secure and assemble the wall structure and the door unit 4 to form the sides of the container, i.e., the container in the assembled state,
- air passages 9*a*, 9*b*, (9*a* or 9*b*) and 9*c*, (9*a* or 9*b*) and 9*d*, each extending through said structure or between two adjacent sides, connecting the internal storage area 1 and the external area 2 of the container,
- airtight seals 8, each placed in or applied against one of said air passages so as to seal the latter to make at least one air passage, i.e., all or almost all of the air passages, airtight so as to make, in association with the wall structure, the container, in the closed state, sufficiently airtight to create in the internal storage area an air-depriving effect, i.e., oxygen-depriving, which automatically and quickly, within a few minutes, smothers and extinguishes any fire starting in said internal area.

More particularly, a container that is sufficiently airtight to create the aforementioned air-depriving (smothering) effect will be defined as a container capable of sufficiently preventing gas exchange, particularly air and more particularly oxygen, between the internal storage area 1 and the external area 2, such that any fire starting in the internal storage area 1 is quickly deprived of air, and therefore of oxygen, the fire benefitting essentially only from the ambient air present in the internal storage area 1 and growing poorer in oxygen as the combustion of the fire progresses, with the effect of smothering and extinguishing the fire within a few minutes, i.e., particularly within less than 5 minutes. Tests performed by this applicant have shown that with such a container, the fire could be smothered and extinguished very quickly within less than 2 minutes and 30 seconds.

It will be understood that such a container can achieve the smothering objective mentioned above even with a small percentage of air passages, up to about 10% to 20% of the air passages, which are not made airtight, i.e., with almost all of the air passages made airtight (about 80 to 100%), without exceeding the scope of this invention. In this case, the time of fire-extinguishing by smothering with such a container would be greater than the optimum time with 100% of air passages made airtight (about 2 minutes and 30 seconds or less), but still less than a time of about 5 minutes that is much less than the current emergency response time (about 45 minutes) to extinguish the fire in current containers. Such a result makes it possible to avoid, in a container according to this invention, any extensive spreading of the fire starting at a given point in the internal storage area. This result also makes it possible to avoid a person located outside of the container being burned by touching the outer wall of the container in the case of a fire that is located inside of the container and that, as is the case with current containers, would remain active for too long causing a spreading of its heat to inside of the walls of the container, particularly when they are metal or made from a material that conducts heat.

It will also be understood that, in all of the airtight seals 8, at least a portion of the latter can be placed in at least a portion of the air passages and/or at least a portion of the airtight seals 8 can be applied against at least a portion of the air passages, so as to make a sufficient number of air passages airtight, preferably each air passage, to make the container sufficiently airtight to create the air-depriving and smothering effect mentioned above.

In a preferred embodiment of the wall structure, as can be seen in FIGS. 1, 3, 4, 5, 6, 7, 8, 9, 10, 11, the latter can comprise panels 5 that are essentially fire-resistant and airtight with a parallelepiped shape, preferably a rectangular parallelepiped shape, and each side 3*a*, 3*b*, 3*c*, 3*d*, 3*e*, 3*f* can be formed by a wall, termed main wall, that can comprise one of the panels 5 or a juxtaposition of several panels 5 and, as necessary, the door unit 4. Furthermore, the panels 5 can be held securely in the assembled state in the container using the securing and assembling system 6*a*, 6*b*, 6*c*; 7*a*, 7*b*, 7*c*, 7*d*, 7*e*, 7*f*, 7*g*. On the other hand, the wall structure can comprise gaps 9*a*, 9*b*, 9*c*, termed main gaps, each defining an air passage space between two juxtaposed panels 5 or between the doorframe 4*a* and one of the panels 5 or, as necessary, between the framing and one of the panels 5. In addition, each air passage can be made, at least in part, of at least one of the main gaps 9*a*, 9*b*, 9*c*. Moreover, the airtight seals 8 can be placed or applied in or against the main gaps 9*a*, 9*b*, 9*c* so as to make each air passage airtight (FIGS. 1, 3, 4, 5, 6, 7, 8, 9, 10, 11).

In a particular form, each airtight seal 8 can be applied against one of the gaps 9*a*, 9*b*, 9*c*, or 9*d* by being placed outside of the latter so as to be able to cover at least in part the length or the height of the air passage or of the corresponding gap, i.e., the length or the height of the opening of the latter coming out into the internal storage area 1 of the container or into the external space 2, preferably in the internal area 1 (FIG. 7).

More particularly, if reference is made to FIG. 1, it can be seen that in an example of embodiment of a wall structure comprising such panels 5, for example with a rectangular or square shape, the main wall forming one of the sides 3*a* of the container can comprise a juxtaposition of panels 5 that can extend in a vertical plane on both sides of the doorframe 4*a* that can be juxtaposed with several panels 5 and air passages that can each be made of one of the gaps 9*a* or 9*b* that can extend vertically or horizontally, depending on the orientation of the longitudinal axis of the panel 5 concerned, between two juxtaposed panels 5 or between the doorframe 4*a* and one of the panels 5. These gaps 9*a* or 9*b* can be made airtight using at least one of the airtight seals 8 so as to make the main wall of the lateral side 3*a* airtight. In this embodiment of the container represented in FIG. 1, the other sides 3*b*, 3*c*, 3*d*, 3*e*, 3*f* of the container do not have a door unit 4 but only a juxtaposition of panels 5 extending in vertical planes for the lateral sides 3*b*, 3*c*, 3*d* and in horizontal planes for the upper side 3*e* and lower side 3*f* and being separated between one another by gaps 9*a* extending horizontally or vertically.

In a variant of the preferred embodiment of the wall structure, so as to create or reinforce the thermal insulation of the container, it can further comprise, on the one hand, parallelepiped-shaped thermal insulation elements 11, preferably of an overall rectangular parallelepiped shape, and each side 3*a*, 3*b*, 3*c*, 3*d*, 3*e*, 3*f* can be formed by a double wall, namely, on the side of the external area 2, by the main wall and, on the side of the internal storage area 1, by an additional wall extending parallel to the main wall (FIGS. 8, 9, 10, 11).

Still in this variant, each additional wall, which can be applied against the inner surface of the main wall, can be made essentially by one of the thermal insulation elements 11 (FIGS. 8, 9 and 11) or by a juxtaposition of several thermal insulation elements 11 (FIG. 10) and, on the other hand, by gaps 9*d*, termed additional gaps, each defining an air passage space between two juxtaposed thermal insulation elements 11 (FIG. 10) or in the thickness of one of the thermal insulation elements 11 (particularly FIGS. 8 and 9). Furthermore, each air passage can be made, at least in part, of at least one of the main gaps 9*a*, 9*b*, 9*c* and of at least one of the additional gaps 9*d*, and each airtight seal 8 can be placed or applied in or against one of the additional gaps 9*d* (FIGS. 9, 10) or one of the main gaps 9*a*, 9*b*, 9*c* (FIGS. 8, 11).

In a first embodiment of the airtightness of each side 3*a*, 3*b*, 3*c*, 3*d*, 3*e*, 3*f* formed by the above-mentioned double wall, the airtight seals 8 can be placed or applied in or against the main gaps 9*a*, 9*b*, 9*c* so as to make only the latter airtight (FIGS. 8, 11).

In a second embodiment of the airtightness of each side 3*a*, 3*b*, 3*c*, 3*d*, 3*e*, 3*f* formed by the double wall, the airtight seals 8 can be placed or applied in or against the additional gaps 9*d* so as to make only the latter airtight (FIGS. 9, 10).

In a third embodiment, not shown, of the airtightness of each side 3*a*, 3*b*, 3*c*, 3*d*, 3*e*, 3*f* formed by a double wall, the airtight seals 8 can be placed or applied in or against the main gaps 9*a*, 9*b*, 9*c* and in or against the additional gaps 9*d* so as to reinforce the airtightness.

Preferably, each additional gap 9*d* can extend in a plane that is approximately merged with the plane containing one of the main gaps 9*a*, 9*b* that define an air passage space between two panels 5 or between the doorframe 4*a* and one of the panels 5. Thus, in the case where the additional wall of each side 3*a*, 3*b*, 3*c*, 3*d*, 3*e*, 3*f* comprises a juxtaposition of thermal insulation elements 11, each main gap 9*a*, 9*b* between two panels 5 or between the doorframe 4*a* and one of the panels 5 can be located approximately in the same plane as one of the additional gaps 9*d* that define an air passage space between two juxtaposed thermal insulation elements 11 (FIGS. 8, 9, 10).

Preferably, each thermal insulation element 11 can comprise a thermal insulation and filler layer 12, which cannot be airtight, applied against the main wall and a layer serving as facing 13, which can be airtight, located on the side of the internal storage area 1 (FIGS. 8, 9, 10, 11).

Thus, considering that the thermal insulation and filler layer 12 cannot be airtight and the layer serving as facing 13 can be airtight, each air passage of such a wall structure having a double wall can comprise, from the external area to the internal storage area, one of the main gaps 9*a*, 9*b*, 9*c* coming out into the external area 2, the thickness of the non-airtight material constituting the thermal insulation and filler layer 12 and one of the additional gaps 9*d* coming out into the internal storage area 1 (particularly FIGS. 8, 9, 10).

The layer serving as facing 13 can be made from a plate or from a plurality of plates 13, preferably metallic or steel, juxtaposed with one another. Each plate can have a rectangular shape and can have an edge folded at 90° forming a peripheral turnback 14 that can be anchored in the thickness of the thermal insulation layer 12.

In addition, the thermal insulation layer 12 can have two major opposite faces 12*a* and 12*b* that are overall parallel to one another, one of which can be applied against the inner surface of the main wall and the other, located on the side of the internal storage area 1, can be covered by the layer serving as facing 13 (FIGS. 8, 9 and 10).

In contrast, the thermal insulation layer 12 can be held securely against the main wall, i.e., against the inner surface of the latter, preferably by clamping and/or locking between the latter and the layer serving as facing 13.

Preferably, the facing layer 13 can be secured, as necessary, to the framing and/or to at least one of the panels 5, using connecting parts 15, for example in the form of plates folded into an L shape, secured using additional securing means 16*a* and 16*b*, preferably removable, such as, for example, bolts, screws or rivets (FIG. 11).

In the case where the thermal insulation layer 12 is made from a thermal insulation element 11 comprising a layer serving as facing 13 that is formed by a juxtaposition of plates 13, the additional gaps 9*d* can each be formed by a gap defining an air passage space between two juxtaposed facing plates 13 and more particularly, as necessary, between the two peripheral turnbacks 14 facing two respective juxtaposed facing plates 13 (FIGS. 8, 9, 10).

Such thermal insulation elements 12 make it possible to ensure and/or reinforce the heat sealing of the wall structure and therefore of the container and can, if necessary, participate in making the container airtight by the presence of airtight seals 8 in or against the additional gaps 9*d*.

Each essentially fire-resistant and airtight panel 5 can comprise two major opposite faces 5*a* and 5*b* that are parallel and connected to one another by a lateral face 5*c* that is perpendicular to the latter (FIGS. 3, 4, 5, 6, 7, 8, 9, 10, 11).

Each airtight seal 8 can have the shape of a flat strip comprising two contact faces 8*a*, 8*b* that are opposite and parallel to one another (see in particular FIG. 4), each strip 8 being able to extend in (FIGS. 3, 4, 5, 6, 8, 9) or outside of (FIG. 8) one of the main or additional gaps 9*a*, 9*b*, 9*c* or 9*d*. Thus, each contact face 8*a*, 8*b* can be applied or secured, totally or partially, depending on the gap 9*a*, 9*b*, 9*c* or 9*d* and depending on its location on the inside (FIGS. 3, 4, 5, 6, 8, 9, 10, 11) or on the outside (FIG. 7) of the latter, on or against one of the panels 5 or the doorframe 4*a* or, as necessary, the framing 7*b*, 7*c*, 7*d*, 7*e*, 7*f*, 7*g* or, as necessary, one of the thermal insulation elements 11.

More particularly, in the case where at least one of the airtight seals 8 is placed in one of the main gaps 9*a*, 9*b* separating two panels 5 or one of the panels 5 and the doorframe 4*a*, the latter being able to comprise a peripheral lateral surface 4*c* (FIG. 2), each airtight seal 8 in the form of a strip can be secured or applied, depending on the gap concerned, on or against the peripheral lateral face 5*c* (FIGS. 4, 5, 6, 8, 9, 10) or one of the major faces 5*a* or 5*b* of one of the panels 5 (FIGS. 5, 6) or the peripheral lateral surface 4*c* of the doorframe 4*a*.

Preferably, the container can further comprise fire-resistant seals 10 (FIGS. 3, 4, 5, 6, 7, 8, 9, 10, 11).

It will be understood that each air passage or each gap, preferably each main gap 9*a*, 9*b*, 9*c* concerned, can comprise at least one fire-resistant seal 10, for example in a particular embodiment, two fire-resistant seals 10 placed facing or approximately opposite one another.

Preferably, each fire-resistant seal 10 can be placed in one of the main gaps 9*a*, 9*b*, 9*c*, if necessary beside one of the airtight seals 8 by extending along the latter, preferably on the side of the internal area 1, i.e., preferably on the side of the opening of the corresponding air passage that comes out directly or indirectly into the internal area 1 (FIGS. 3, 4, 5, 6, 8, 11).

In the case where the wall structure comprises a double wall, each fire-resistant seal 10 can be placed, preferably, in one of the main gaps 9*a*, 9*b*, 9*c*, which are not made airtight, of the main wall of the corresponding side (FIGS. 9 and 10).

Such fire-resistant seals 10 make it possible to ensure the fire-resistant sealing of the main gaps 9*a*, 9*b* between the panels 5 and between the doorframe 4*a* and at least one of the panels 5 and, optionally, to protect the airtight seals 8 in case of fire coming from outside of the container.

Preferably, each fire-resistant seal 10 can be, for example, an intumescent seal consisting of a heat-expanding material and can be, for example, in the form of a strip that can be incorporated into or secured onto the peripheral lateral face 5*c* or one of the major faces 5*a* or 5*b* of one of said panels 5 or the peripheral lateral surface 4*c* of the doorframe 4*a* (FIGS. 3, 4, 5, 6, 7, 8, 9, 10, 11).

Preferably, each airtight seal 8 can be, for example, an airtight seal of the type marketed under the reference "ILLBRÜCK FJ400."

Each fire-resistant and airtight panel 5 can comprise a board of fire-resistant material 5*d*, for example known under the trade name or filed name "Aestuver," preferably with a thickness of between 30 and 70 cm, which can be covered on both sides, on at least a portion of its major faces, with a sheet of steel facing 5*e* (particularly FIGS. 3, 4, 5, 6, 7, 8, 9, 10, 11).

The, or each, fire-resistant and airtight door unit 4 can be, for example, a door unit marketed by this applicant under the trade name "BAUMERT EPRING."

This invention can include a juxtaposition and an assembling of one or more rows of panels 5 to make the main wall of each side 3*a*, 3*b*, 3*c*, 3*d*, 3*e*, 3*f* of the container (FIG. 1).

In contrast, the panels 5 can assume different shapes and dimensions depending on the type of placement provided in the sides of the container. For example, each lateral side 3*a*, 3*b*, 3*c* and 3*d* can comprise a row of panels 5, for example of rectangular shape and oriented vertically, and each upper or lower side 3*e* or 3*f* can comprise, for example, two rows of panels 5, for example square-shaped (FIG. 1).

Preferably, to facilitate and make possible a more rapid assembly or disassembly of the container, this invention can also provide that the airtight seals 8 and, as necessary, the fire-resistant seals 10 can be secured, prior to the assembly of the container, on the panels 5, particularly on their lateral face 5*c*, and/or on the doorframe 4*a*, particularly on its lateral surface 4*c*, so as to avoid during the assembly of the container, particularly on site, the operations of positioning and securing the seals 8 or 10.

In a first embodiment of the securing and assembling system 6, without reinforcing framing, the securing and assembling system can comprise main first securing means 6*a*, for example of the bolt, screw or rivet type, and a set of rigid connecting parts 6*b*, 6*c*, preferably metallic, that can ensure, using the first securing means 6*a*, the rigid connection, on the one hand, between the panels 5 and, on the other hand, between the doorframe 4*a* and at least one of the panels 5. Each connecting part 6*b*, 6*c* can extend on both sides of one of the main gaps 9*a*, 9*b* between two panels 5 or between the doorframe 4*a* and one of the panels 5 (FIG. 5).

In a preferred embodiment of the container, the latter can have a rectangular parallelepiped shape and the set of connecting plates 6*b*, 6*c* can comprise a first set of flat connecting plates 6*b* ensuring the rigid connection, on the same side of the container, between the panels 5 and, as necessary, between the doorframe 4*a* and at least one of the panels 5 and a second set of L-shaped connecting plates 6*c* forming angle bars ensuring the rigid connection, in the area of each edge of the container, between the panels 5 and, as necessary, between the doorframe 4*a* and at least one of the panels 5 (FIGS. 5, 6).

More particularly, as can be seen in FIG. 5 and in FIG. 6, each flat or L-shaped connecting plate 6*b* or 6*c* connecting two panels 5, as necessary, the doorframe 4*a* and one of the panels 5 can be secured using the first securing means 6*a*, on both sides of one of the gaps 9*a* or 9*b* concerned, either on the major faces 5*a* or 5*b* of the two juxtaposed panels concerned, or, as necessary, on the doorframe 4*a* and on one of the major faces 5*a* or 5*b* of the, or of one of the panels 5 that is juxtaposed with the latter.

In a second embodiment of the securing and assembling system, the latter can comprise the second main securing means 7*a*, for example of the bolt, screw or rivet type, and the framing 7*b*, 7*c*, 7*d*, 7*e*, 7*f*, 7*g*. Furthermore, the framing can have an overall parallelepiped shape that is similar to that of the container, preferably rectangular parallelepiped, and can extend approximately in the plane of each side 3*a*, 3*b*, 3*c*, 3*d*, 3*e* or 3*f* of the container between the panels 5 and the internal storage area 1. On the other hand, the framing can have, in each side 3*a*, 3*b*, 3*c*, 3*d*, 3*e* or 3*f* and on the side of the external area 2, a bearing surface 7*b* parallel to the plane of the side 3*a*, 3*b*, 3*c*, 3*d*, 3*e* or 3*f* concerned. Each panel 5 and the doorframe 4*a*, which can have, for example, the shape of a frame (FIG. 2), can be assembled on the framing while being applied and secured, by the securing means 7*a*, against and on the bearing surface 7*b* concerned (FIGS. 1, 2 and 3).

In this second embodiment of the securing and assembling system, the wall structure can further comprise continuity and corner elements of the fire-resistant panel 5' that are airtight, preferably of elongated shape, and preferably with a square or rectangular cross-section. Each continuity and corner element of panel 5' can extend along one of the edges of the container so as to achieve continuity between two planes of panels 5 that delimit the edge concerned and that are set back from the latter. Moreover, each air passage can be formed by one of the main gaps 9*c* between the bearing surface 7*b* of the framing 7*b*, 7*c*, 7*d*, 7*e*, 7*f*, 7*g* and at least one of the panels 5 and by one of the main gaps 9*a* between the continuity and corner element of panel 5' concerned and the panel or panels 5 that is or are juxtaposed with the latter (FIG. 3).

In a preferred embodiment of the framing, the latter can comprise a set of beams 7*c, d,* 7*e*, 7*f*, 7*g*, preferably metallic or steel, which can each comprise at least one bearing face 7*b* located on the external side of the container, and each edge of the framing can be formed by at least one of the beams so that the bearing faces 7*b* of each side of the framing can extend approximately in the same plane to form the bearing surface of the corresponding side of the framing (FIG. 2). Thus, in the case of a rectangular parallelepiped-shaped framing, in the assembled state on a horizontal surface, the latter can comprise a first set of beams 7*c* forming the horizontal edges of the major lateral sides of the framing, a second set of beams 7*d* forming the horizontal edges of the small sides of the framing, and a third set of beams 7*e* forming the vertical edges of the framing (FIG. 2).

Furthermore, each beam 7*c*, 7*d*, 7*e* of the first and second sets can comprise two external faces forming two bearing faces 7*b*, extending approximately perpendicular to one another so that one of the two bearing faces 7*b* of each beam extends in one of the sides 3*a*, 3*b*, 3*c*, 3*d*, 3*e,* or 3*f* of the container and the other bearing face 7*b* in one of the other sides extends perpendicular to said side. Preferably, each beam 7*c*, 7*d*, 7*e* can be L-shaped so as to form two wings that are approximately perpendicular to one another, whose external faces each form one of the bearing faces 7*b*.

In contrast, the framing can further comprise a third beam set 7*f*, 7*g* making it possible to reinforce the framing by connecting crosswise two opposite edges that are parallel to one another. For example, in the case of a rectangular parallelepiped-shaped framing, the third set can comprise two beams 7*f* and 7*g*, one of which connects crosswise, preferably approximately at their midpoint, the two beams 7*c* forming the horizontal edges of the small upper lateral sides of the framing and a beam 7*g* connecting crosswise, preferably at their midpoint, the two beams 7*c* forming the horizontal edges of the major lower lateral sides of the framing (FIG. 2). It will be understood that each beam, of the third set, which comprises one of the bearing faces 7*b*, also makes it possible to add in the corresponding side of the container an additional bearing face 7*b,* particularly for securing the panels 5, between two beams of the first set or of the second set, each forming one of the edges.

Preferably, the securing and assembling system can comprise connecting means and third main securing means, not shown, such as bolts, screws or rivets, making it possible to connect and to secure the beams to one another, preferably by their free ends. Furthermore, the connecting means can consist of corner parts each forming a top of the framing that can connect at least two free ends of beams to one another and that can be secured using the third securing means.

This invention can also provide that such a container can be entirely able to be disassembled in order to allow its disassembly or its presentation in disassembled form making possible its delivery in separate parts or as a kit, for example to make possible the passing of the container through a door of smaller dimensions for its removal or its installation. For this purpose, this invention can provide that the securing and assembling system is able to be disassembled and that, as necessary, the framing can be disassembled.

Furthermore, still to facilitate the assembly or disassembly of the container, this invention can provide that the airtight seals 8 and, as necessary, the fire-resistant seals 10 are secured, prior to the assembly of the container, on the panels 5 and on the doorframe 4*a*, more particularly on at least one of the lateral faces 5*c* of the panels 5 and on at least one portion of the lateral surface 4*c* of the doorframe 4*a*.

The securing and assembling system can be made able to be disassembled by providing that the first, second or third securing means 6*a*, 7*a*, if necessary the additional securing means 16*a*, 16*b*, are able to be disassembled, such as, for example, bolts or screws, making it possible, more particularly, easily to disassemble or assemble each connecting plate 6*b* or 6*c* and therefore easily to disassemble or assemble the panels 5 and the doorframe 4*a* or to disassemble or assemble the panels 5 and doorframe 4*a* on the framing 7*b*, 7*c*, 7*d*, 7*e*, 7*f*, 7*g* or, if necessary, to assemble or disassemble the thermal insulation elements 11 on the main walls consisting of panels 5 and/or on the framing.

Thus, in the case where the framing comprises a plurality of beams 7*c*, 7*d*, 7*e*, 7*f*, 7*g*, this invention can provide third securing means that can be disassembled so as to be able to make possible the disassembly of the beams.

In contrast, this invention can provide a footing system 17, preferably secured to the external face of the lower side 3*f* of the container, comprising, preferably, a plurality of feet 17, preferably each adjustable in height (FIGS. 1 and 2). If necessary, each foot 17 can be secured preferably to one of the beams 7*c*, 7*d*, 7*e*, 7*f*, 7*g* of the framing. Such a footing can thus be used to raise and/or, as necessary, to adjust the horizontality of the lower side 3*f* of the container (FIG. 2).

Of course, the invention is not limited to the embodiment described and represented in the accompanying drawings. Modifications remain possible, particularly from the viewpoint of the composition of the various elements or by substitution of technical equivalents, without thereby exceeding the field of protection of the invention.

The invention claimed is:

1. Fire-resistant and fire-smothering storage container having an overall parallelepiped shape and housing an internal storage area (1) for the storage of materials, which is delimited, in relation to the external area (2) of the container, by a plurality of sides (3*a*, 3*b*, 3*c*, 3*d*, 3*e*, 3*f*), of which at least one of the latter comprises at least one access opening, making it possible for persons and materials to pass through, closed by a fire-resistant door unit (4) comprising a doorframe (4*a*) and at least one door leaf (4*b*), wherein the container comprises:

a structure of walls (5, 5', 11) that are essentially fire-resistant and airtight and that form, as necessary with the door unit (4) that is adapted also to be airtight, each side (3*a*, 3*b*, 3*c*, 3*d*, 3*e*, 3*f*), a securing and assembling system (6*a*, 6*b*, 6*c*; 7*a*, 7*b*, 7*c*, 7*d*, 7*e*, 7*f*, 7*g*), optionally comprising a reinforcing framing (7*b*, 7*c*, 7*d*, 7*e*, 7*f*, 7*g*), said system making it possible to secure and assemble said structure and the door unit (4) to form said sides, air passages (9*a*, 9*b*, 9*c*, 9*d*) each extending through said structure or between two adjacent sides by connecting the internal storage area (1) and the external area (2), airtight seals (8) each placed in or applied against one of said air passages so as to seal the latter to make all or almost all of the air passages airtight so as to make, with the wall structure, the container, in the closed state, sufficiently airtight to create in the internal storage area an air-depriving effect that automatically, within a few minutes, smothers and extinguishes any fire starting in said internal area.

2. Container, according to claim 1, wherein the wall structure comprises, on the one hand, panels (5) that are essentially fire-resistant and airtight with a parallelepiped shape, and each side (3*a*, 3*b*, 3*c*, 3*d*, 3*e*, 3*f*) that delimits the internal storage area (1) is formed by a wall, termed main wall, comprising one of the panels (5) or a juxtaposition of several panels (5) and, as necessary, the door unit (4), said panels (5) being held securely in the assembled state using the securing and assembling system (6*a*, 6*b*, 6*c*; 7*a*, 7*b*, 7*c*, 7*d*, 7*e*, 7*f*, 7*g*) and, in the other hand, gaps, termed main gaps (9*a*, 9*b*, 9*c*), each defining an air passage space between two juxtaposed panels (5) or between the doorframe (4*a*) and one of the panels (5) or, as necessary, between the framing and one of the panels (5), and wherein each air passage is made, at least in part, of at least one of the main gaps (9*a*, 9*b*, 9*c*).

3. Container, according to claim 2, wherein the airtight seals (8) are placed or applied in or against the main gaps (9*a*, 9*b*, 9*c*).

4. Container, according to claim 3, wherein the wall structure further comprises, on the one hand, parallelepiped-shaped thermal insulation elements (11) and each side (3*a*, 3*b*, 3*c*, 3*d*, 3*e*, 3*f*) is formed by a double wall, namely, on the side of the external area, by the main wall and, on the side of the internal storage area (1), by an additional wall extending parallel to the main wall and being made by one of the thermal insulation elements (11), or by a juxtaposition of several thermal insulation elements (11) and, on the other hand, gaps, termed additional gaps (9*d*), each defining an air passage space between two juxtaposed thermal insulation elements (11) or in the thickness of one of the thermal insulation elements (11), each air passage being made, at least in part, by at least one of the main gaps (9*a*, 9*b*, 9*c*) and by at least one of the additional gaps (9*d*) and wherein each airtight seal (8) is placed or applied in or against one of the additional gaps (9*d*) or, as necessary, one of the main gaps (9*a*, 9*b*, 9*c*).

5. Container, according to claim 2, wherein the wall structure further comprises, on the one hand, parallelepiped-shaped thermal insulation elements (11) and each side (3*a*, 3*b*, 3*c*, 3*d*, 3*e*, 3*f*) is formed by a double wall, namely, on the side of the external area, by the main wall and, on the side of the internal storage area (1), by an additional wall extending parallel to the main wall and being made by one of the thermal insulation elements (11), or by a juxtaposition of several thermal insulation elements (11) and, on the other hand, gaps, termed additional gaps (9*d*), each defining an air passage space between two juxtaposed thermal insulation elements (11) or in the thickness of one of the thermal insulation elements (11), each air passage being made, at least in part, by at least one of the main gaps (9*a*, 9*b*, 9*c*) and by at least one of the additional gaps (9*d*) and wherein each airtight seal (8) is placed or applied in or against one of the additional gaps (9*d*) or, as necessary, one of the main gaps (9*a*, 9*b*, 9*c*).

6. Container, according to claim 5, wherein each additional gap (9*d*) extends in a plane that is approximately merged with the plane containing one of the main gaps (9*a*, 9*b*) defining an air passage space between two panels (5) or between the doorframe (4*a*) and one of the panels (5).

7. Container, according to claim 2, wherein each airtight seal (8) has the shape of a flat strip comprising two contact faces (8*a*, 8*b*) that are opposite and parallel to one another, each strip (8) extending into or outside of one of the main or, if applicable, additional gaps (9*a*, 9*b*, 9*c*, 9*d*), each contact face (8*a*, 8*b*) being applied or secured, totally or partially, on or against one of the panels (5) or the doorframe (4*a*) or, as necessary, the framing or, as necessary, one of the thermal insulation elements (11).

8. Container, according to claim 2, wherein it further comprises fire-resistant seals (10), each placed in one of the main gaps (9*a*, 9*b*, 9*c*), if necessary, beside one of the airtight seals (8) by extending along the latter.

9. Container, according to claim 2, wherein the securing and assembling system comprises first securing means (6*a*), for example of the bolt, screw or rivet type, a set of rigid connecting parts (6*b*, 6*c*) ensuring, using the first securing means (6*a*), the rigid connection, on the one hand, between the panels (5) and, on the other hand, between the doorframe (4*a*) and at least one of the panels (5), each connecting part (6*b*, 6*c*) extending on both sides of one of the main gaps (9*a*, 9*b*) between two panels (5) or between the doorframe (4*a*) and one of the panels (5).

10. Container, according to claim 9, wherein the container has a rectangular parallelepiped shape and wherein the set of connecting parts (6*b*, 6*c*) comprises a first set of flat connecting plates (6*b*) ensuring the rigid connection, on the same side of the container, between the panels (5) and, as necessary, between the doorframe (4*a*) and at least one of the panels (5) and a second set of L-shaped connecting plates (6*c*) forming angle bars ensuring the rigid connection, in the area of each edge of the container, between the panels (5) or, as necessary, between the doorframe (4*a*) and at least one of the panels (5), each flat or L-shaped connecting plate (6*b*) being secured, using the first securing means (6*a*), either on the major faces (5*a*, 5*b*) of the two juxtaposed panels (5) concerned, or, as necessary, on the doorframe (4*a*) and on one of the major faces (5*a*, 5*b*) of the, or of one of the, panels (5) that is juxtaposed with the latter.

11. Container, according to claim 9, wherein the securing and assembling system comprises second securing means, connecting means and third securing means, the container is able to be disassembled, and wherein the first, second and the third securing means can be disassembled.

12. Container, according to claim 2, wherein the securing and assembling system comprises second securing means (7*a*), for example of the bolt, screw or rivet type, and the reinforcing framing (7*b*, 7*c*, 7*d*, 7*e*, 7*f*, 7*g*), the latter having an overall parallelepiped shape that is similar to that of the container and extending approximately in the plane of each side (3*a*, 3*b*, 3*c*, 3*d*, 3*e*, 3*f*) between the panels (5) and the internal storage area (1) and wherein said framing has, in each side and on the side of the external area (2), a bearing surface (7*b*) parallel to the plane of the side concerned and wherein each panel (5) and the doorframe (4*a*) are assembled on said framing while being applied and secured, using said second securing means (7*a*) against and on the bearing surface (7*b*) concerned.

13. Container, according to claim 12, wherein the wall structure further comprises continuity and corner elements of the panel (5') that are fire-resistant, airtight, and of elongated shape, preferably with a square or rectangular cross-section, each continuity and corner element of the panel (5') extending along one of the edges of the container so as to achieve continuity between two planes of panels (5) that delimit the edge concerned and that are set back from the latter and wherein each air passage is formed by one of the main gaps (9*c*) between the bearing surface (7*b*) of the framing (7*b*, 7*c*, 7*d*, 7*e*, 7*f*, 7*g*) and at least one of the panels (5) and by one of the main gaps (9*a*) between the continuity and corner element of the panel (5') concerned and the panel or panels (5) that is or are juxtaposed with the latter.

14. Container, according to claim 13, wherein the framing (7) comprises metal beams (7*c*, 7*d*, 7*e*, 7*f*, 7*g*), each comprising at least one bearing face (7*b*) located on the external side of the container, and wherein each edge of said framing is formed by at least one of said beams so that the bearing faces (7*b*) of each side of the framing extend approximately in the same plane to form the bearing surface (7*b*) of the corresponding side of the framing, and wherein the securing and assembling system further comprises connecting means and third securing means that make it possible to connect and secure the beams to one another, preferably by one of their free ends.

15. Container, according to claim 12, wherein the framing (7) comprises metal beams (7*c*, 7*d*, 7*e*, 7*f*, 7*g*), each comprising at least one bearing face (7*b*) located on the external side of the container, and wherein each edge of said framing is formed by at least one of said beams so that the bearing faces (7*b*) of each side of the framing extend approximately in the same plane to form the bearing surface (7*b*) of the corresponding side of the framing, and wherein the securing and assembling system further comprises connecting means and third securing means that make it possible to connect and secure the beams to one another, preferably by one of their free ends.

16. Container, according to claim 2, wherein it is presented in a disassembled form that makes possible its delivery in separate parts or as a kit and wherein the airtight seals (8) and, as necessary, the fire-resistant seals (10) are secured, prior to the assembly of the container, on the panels (5) and/or on the doorframe (4*a*).

* * * * *